US005927291A

United States Patent [19]

Beall

[11] Patent Number: 5,927,291

[45] Date of Patent: Jul. 27, 1999

[54] HAIR STYLING APPARATUS

[76] Inventor: Lisa Beall, 6016 Mt. Bonnell Cove, Austin, Tex. 78731

[21] Appl. No.: 09/185,199

[22] Filed: Nov. 3, 1998

Related U.S. Application Data

[63] Continuation-in-part of application No. 09/092,366, Jun. 5, 1998.

[51] Int. Cl.[6] ..... A45D 24/38; A45D 24/04

[52] U.S. Cl. ..... 132/144; 132/145; 132/146; 132/127

[58] Field of Search ..... 132/144, 127, 132/137, 901, 145, 146, 148; D28/28, 32

[56] References Cited

U.S. PATENT DOCUMENTS

| | | | |
|---|---|---|---|
| 1,386,296 | 8/1921 | Wessa | 132/142 |
| 1,580,365 | 4/1926 | Bechtold | 132/137 |
| 1,714,358 | 5/1929 | Finkelstein | 132/137 |
| 1,780,206 | 11/1930 | McKellar | 132/137 |
| 2,176,460 | 10/1939 | Kruger et al. | 132/137 |
| 2,506,297 | 5/1950 | Goodman | 132/137 |
| 4,359,061 | 11/1982 | Colclasure | 132/144 |
| 5,261,428 | 11/1993 | Wu . | |
| 5,284,167 | 2/1994 | Gill . | |
| 5,464,167 | 11/1995 | Avellanet . | |
| 5,499,638 | 3/1996 | Ripley . | |
| B1 5,036,870 | 7/1995 | Edmark . | |

FOREIGN PATENT DOCUMENTS

| | | | |
|---|---|---|---|
| 366747 | 10/1906 | France | 132/144 |
| 6637 | 4/1902 | United Kingdom | 132/144 |

*Primary Examiner*—John J. Wilson
*Assistant Examiner*—Robyn Doan
*Attorney, Agent, or Firm*—Williams, Morgan & Amerson

[57] ABSTRACT

A hair styling device is provided for holding hair in place, particularly upsweep styles in the form of twists or French twists. The invention is particularly in the form of a comb with teeth conforming generally to the shape of the head so as to insert into an elongated twist of hair folded against the head. Separately offset arched sections on the teeth provide for insertion of a locking pin which serves to securely hold hair in place without the need for auxiliary anchors such as hairpins and clamps.

31 Claims, 5 Drawing Sheets

HAIR STYLING APPARATUS

This application is a continuation-in-part of U.S. patent application Ser. No. 09/092,366 filed Jun. 5, 1998, the contents of which are specifically incorporated herein in their entirety without disclaimer.

1.0 BACKGROUND OF THE INVENTION

1.1 Field of the Invention

The present invention pertains to systems for styling hair, and more particularly to combs for holding hair in place. The invention especially concerns a comb whose teeth are shaped along their length to define a channel extending along the comb. The comb is used in combination with a locking pin which is inserted into the channel.

1.2 Related Art

Many devices, methods and compositions have been developed to style hair and to hold the styles in place. Bobby pins, hair pins and combs are among the more common devices employed for these purposes. Styles involving long hair, other than very simple styles, have generally posed some of the more difficult styling problems. Pony tails, for example, represent a relatively simple style. Twists, on the other hand, while attractive in appearance, have been much more difficult to implement. The French twist is particularly attractive but also particularly difficult to maintain.

"Upswept" hair styles in a general sense include styles in which strands of hair are pulled, folded, rolled, teased, twisted, layered or otherwise swept upward into a bun, twist or other hair structure. Twist hair styles, for example, in a general aspect involve combining or assembling long strands of hair in a compact bundle or lump, twisting part of the bundle or lump on itself, and then anchoring or otherwise locking the twisted product in place. Bobby pins, hairpins, clamps, and the like typically serve as the locking devices. Unfortunately, these devices frequently fail and the styling procedure must then be repeated.

The so-called French twist is a particular favorite in styling long hair in preference to pony tails, braids, pig tails, etc. A popular French twist for long hair involves gathering a person's long hair to form a long tail, folding the tail upward in a layered bun, and then twisting one side of the bun laterally over the bun. An elongated crease or indentation thereby appears alongside the twisted bun. Bobby pins, combs and the like are then inserted into the bun for the purpose of binding the bun together. Unfortunately, as noted above, the binding devices and techniques all too frequently fail to hold the hair securely in place.

To style one's hair in such a way that the person's hair is pulled up as in a French twist or other upswept style, is a difficult matter. Typically, most people rely on professional help to have their hair fashioned in upswept styles. This reliance entails not only considerable expense but also time and inconvenience.

As performed by professional hair stylists, upswept hair styles generally involve twisting a person's hair up by hand into a desired style, tucking the ends of the hair into the twisted hair, and then securing the hair with many bobby pins, hair spray and the like. To cover up the bobby pins, a decorative comb is frequently inserted into the hair and more bobby pins may then be added to hold the comb in place. Despite the use of skilled professionals, bobby pins, combs and the like, upswept hair styles still have an unfortunate propensity to fail.

2.0 SUMMARY OF THE INVENTION

The present invention is directed to the problems described above. In one broad aspect the present invention comprises two sets of hair comb teeth in which first teeth of a first set extend generally parallel to second teeth of a second set and wherein a section along the length of the first teeth is offset, arched or otherwise displaced relative to the second teeth to define a channel extending between the two sets when in an operative position in a hair style. The channel is sufficiently large to receive or capture numerous strands of hair from within a bun or other hair style when the two sets of teeth enter the hair style and reach an operative position. Teeth of both sets are distributed along the channel and preferably spaced along the channel. A preferred pattern is one in which the teeth of one set alternate with teeth of the other set, but other patterns may be employed. Thus, every third or fourth tooth may be a tooth of one set instead of every other tooth. More irregular or random patterns may also be employed, but teeth of both sets should appear and be spaced along the channel.

In one embodiment of the invention, the two sets of teeth may have a common spine. In another embodiment, each set of teeth may have its own spine, effectively constituting two combs. In this embodiment, the teeth of both sets may enter the styled hair in the same direction into a generally side-by-side operative position and define a channel, as described earlier for a single comb. Alternatively, the two sets of teeth may enter a hair style in opposite directions, i.e., the ends of the two sets of teeth approach and pass each other until their channel forming sections are opposite one another to define a channel.

The invention also comprises an elongated member which may be generically referred to as a pin. This member is inserted into any of the channels mentioned above to wedge captured hair within the channel. The pin thus serves as a wedging member and helps to lock the captured hair within the channel. The pin, however, preferably includes one or more locking features or elements which engage teeth or other comb components to lock the teeth and captured hair in place in the hair style. The locking feature may be an integral part of a pin's structure itself, such as a notch configured to receive and hold a tooth. Alternatively, it may be an added feature or member or element such as a magnet, a Velcro patch, a snap or other fastener adapted to engage a companion fastener on a comb.

The pin component preferably has an enlarged head at one end to restrict entry into the channel and it tapers to a rounded point at the other end. The locking feature of the pin may be positioned on the head which may also have decorative features.

Combs of the invention are preferably curved along their length and along their teeth to conform to the shape of a person's head. Thus, if a comb is to be used with the teeth extending laterally, the teeth are curved along their length to rest against and extend around the back of the head. The entire comb is also preferably curved along its length to rest against and extend down the back of the head.

A single comb embodiment of the invention comprises a comb with two sets of teeth which are shaped along their lengths to define one or more channels running between the sets of teeth and generally parallel to the spine of the comb. Thus, one set of teeth is preferably relatively straight, and the other set is preferably arched or otherwise displaced at one or more sections along its length to define a corresponding one or more channels with the first set. The points of the teeth of both sets preferably are in even alignment. Each channel resembles a ribbed passageway in which the teeth resemble ribs spaced along the passageway.

The single comb embodiment preferably forms one component of a styling tool which also includes a locking pin.

The term "pin" is used herein in a generic sense and embraces elongated members such as rods. This member extends through the channel defined by the two sets of teeth and is preferably curved to conform to the curved shape of the channel. This member is inserted into the channel after the comb has been placed in a head of hair to wedge the strands of hair within the channel between this member and the rows of teeth.

This wedging action helps to lock the comb and its hair style in place. The elongated locking pin also is preferably configured or modified to perform a further or direct inter-engaging locking function when inserted into a comb in its operative position. Thus, it may be notched, it may include a hook, or may be otherwise configured at one or more points along its length to engage in a locking relationship with the comb. Alternatively, it may carry a snap, a Velcro patch, or other suitable mechanical fastener for engaging a companion fastener member on the comb. The locking arrangement should be readily releasable to permit removal of a comb from a hair style when desired.

The locking feature of the pin is located on the member at a point to become operative, when the member reaches its operative position in the channel defined by the comb. Operation of the locking feature not only locks the elongated member to the comb, but also locks strands of hair which have been wedged in the comb by the pin. The locking pin thereby greatly reduces or eliminates danger of the pin or the wedged hair from backing out of the comb.

In the case of a French twist, a single comb of the invention may be inserted along and proximate to the crease or indentation, mentioned earlier, which helps to characterize a French twist. Thus, the teeth are inserted into a twist such that layers of hair in the twisted bun are worked into the channel or channels defined by the two sets of teeth. A pin wedged or otherwise locked into each channel then firmly holds the layers of hair within the channel or channels and thereby maintains the twist.

The combs and pins of the invention may be made of many different materials, including those conventionally used in combs. Especially preferred materials are polycarbonates. It is also preferred that the surfaces of the combs not be so shiny or smooth as to slip when engaged in hair. The surfaces preferably should be of a non-slip nature. Combs and pins made from extruded plastics, especially polycarbonates, have proven to be very effective. They are tough and lightweight and also flexible enough to be readily disengaged from a locking position when removal from a hair style is desired.

In another broad aspect the invention resides in a method of styling hair, especially twists and other upswept hair structures, by inserting a single comb in the structures wherein the teeth are shaped to define one or more channels extending along the comb. Each channel is spacious enough to receive or otherwise capture strands of hair from within the hair structure, preferably throughout the structure. A pin of this invention is then inserted in the channel to wedge the captured hair within the channel. With the pin in this operative position, the pin also preferably engages the comb to lock the wedged hair in the comb. When release of the hair is desired, the pin is disengaged from the comb and both the pin and the comb are removed from the hair. The pin may be inserted in and locked to the comb when not in use to keep the two components conveniently together.

In a preferred two-comb embodiment, the invention comprises a pair of combs, each having a set of teeth, which may be assembled in a ponytail or other tail hairstyle by bringing the two sets of teeth toward each other in the style. The teeth of both sets are distributed, preferably alternately, to define a channel extending along and between the two combs. One or more sections along the length of the teeth of one set are arched, curved or otherwise displaced relative to the teeth of the other set to define the channel. In this manner, strands of hair are received or otherwise captured in the channel. A pin of the general type mentioned earlier is then inserted into the channel to engage at least one of the combs and preferably both combs. In this instance the locking pin may have two locking features, one feature for each comb. Thus, the pin may have two spaced notches configured to engage correspondingly spaced teeth on the two combs. Preferably, the teeth are adjacent teeth, each tooth forming a part of one of the combs.

In yet another aspect the invention resides in a kit which comprises one or more combs and one or more locking pins of the invention in a package or other container, preferably sterile and in a blister pack or the like. In one preferred kit, a plurality of pins having different thicknesses are combined with each comb to enable hair of different properties to be handled more effectively. The teeth may also vary in size or spacing to improve such handling. Various decorative attachments may also be included in the kits.

The embodiments described may be modified in various ways within the scope and spirit of the invention. For example, the dimensions of the comb may be of a size appropriate for children or teenagers so as to better conform to head size. Decorative elements may be customized for particular age groups and packaged in accordance with customer preference.

3.0 BRIEF DESCRIPTION OF THE DRAWINGS

4.0 DETAILED DESCRIPTION OF A PREFERRED EMBODIMENT

Figure 1:
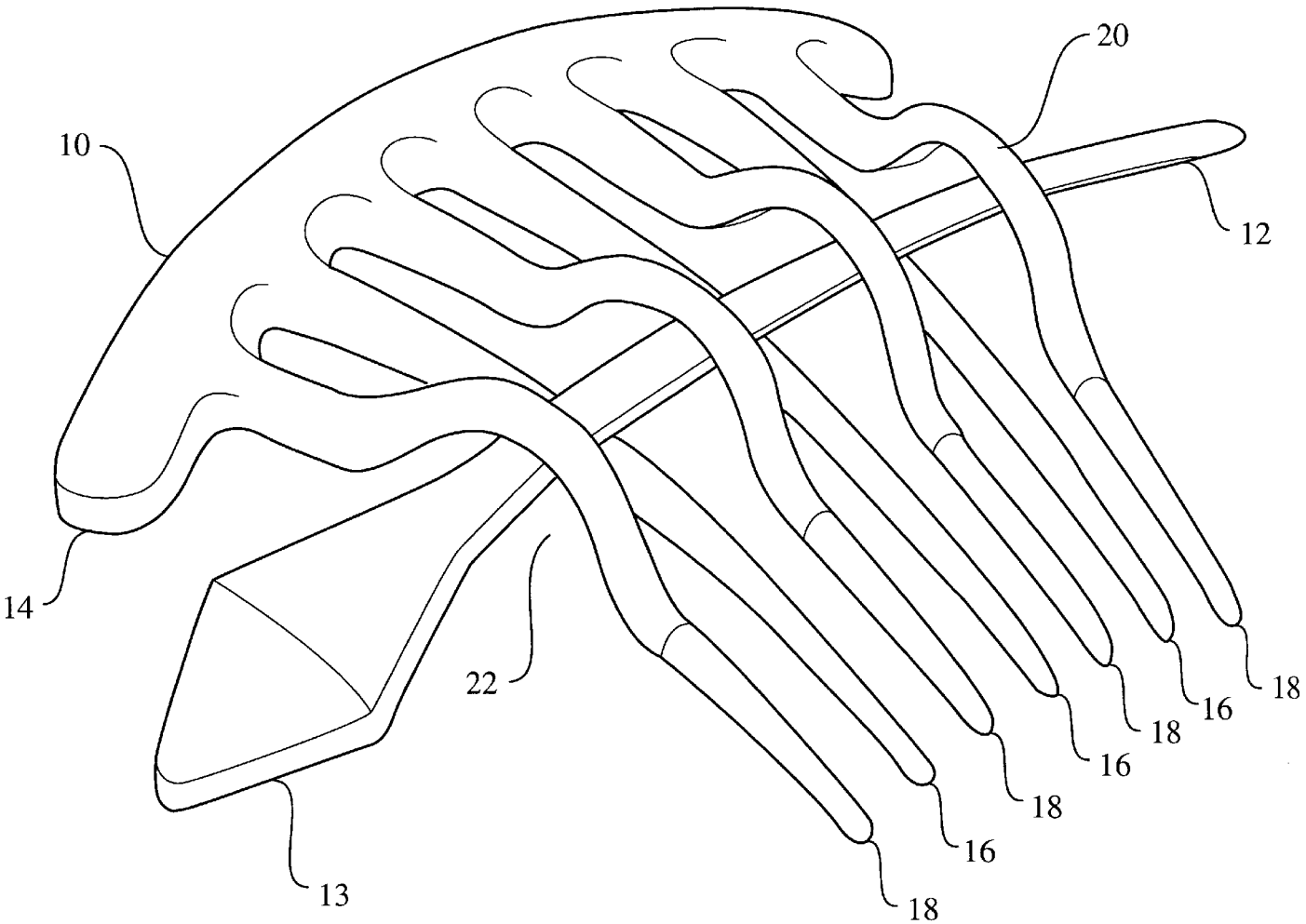
FIG. 1 is a perspective top view of a comb of the invention, including a pin or wedge member employed with the comb.
Figure 2:
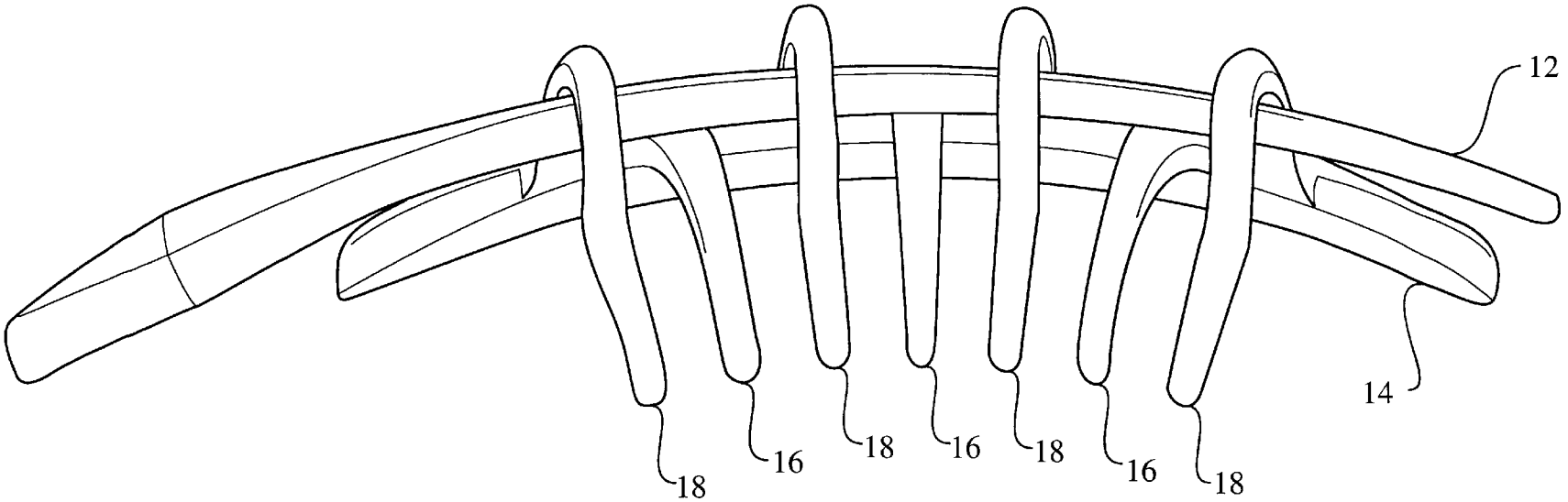
FIG. 2 is a perspective side view of the comb of FIG. 1.
Figure 3:
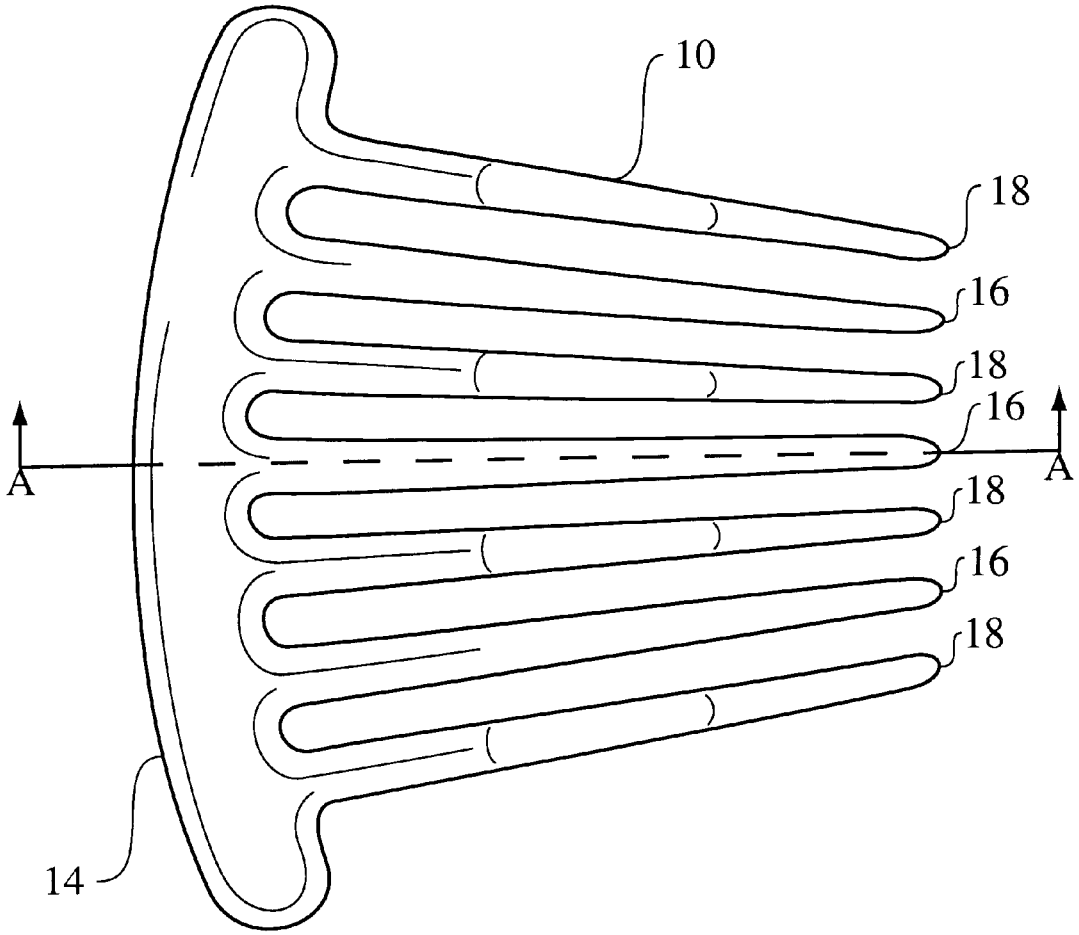
FIG. 3 is a plan view of the comb of FIG. 1 without the locking pin.

One embodiment of the invention, especially suitable for French twists, is shown in FIGS. 1–3. The embodiment comprises a comb 10 and a pin 12. The comb includes a spine 14, a first set of first teeth 16, and a second set of second teeth 18. As shown in FIG. 2, the spine 14 and the pin 12 are curved along their length to conform to the shape of a human head along generally vertical lines. As shown in FIG. 1, all of the teeth 16 and 18 are curved to conform to the shape of a human head along generally lateral lines. In addition, the teeth 18 have a separately offset or arched section 20 which extends above the teeth 16 to form a ribbed passageway capable of receiving the pin 12.

Typical dimensions for the spine of a comb suitable for use in a French twist include a length of about four inches (about 100 mm), a width of about one-half inch (about 13 mm), and a thickness of about 3/16 inch (approximately 5 mm). The teeth 16 are about three inches long (approximately 75 mm) and are curved with a radius of curvature of about 4–8 inches (approximately 100 mm to 200 mm), preferably about 5–6 inches (approximately 124 mm to 150 mm). The arched sections of the teeth 18 are positioned about midway along these teeth raised about 1 inch (13 mm) from the teeth. They have a radius of curvature of about 1/8 to about 2 inches (approximately 3 mm to approximately 50 mm) and preferably about 3/4 inch (approximately 20 mm). The tips of the teeth are about 3/32 inch (approximately 2.5 mm) wide by about 1/16 inch (approximately 1.5 mm) thick. However, in many aspects of common use it is believed that the curvature of the teeth will be about 3 inches (approximately 70 mm) and the arched sections from about 1/8 inch to about 7/8 inch (approximately 3 mm to approximately 22 mm). The teeth taper in width and thickness along their length from the thickness of the spine to their rounded tips. The spacing between adjacent teeth is about one-quarter inch (approximately 6 mm). In general, the channel defined by the teeth is large enough to receive and capture strands of hair from throughout a twist or other hair style. The teeth get longer toward the middle of the comb, because the spine is preferably arched.

Figure 4:
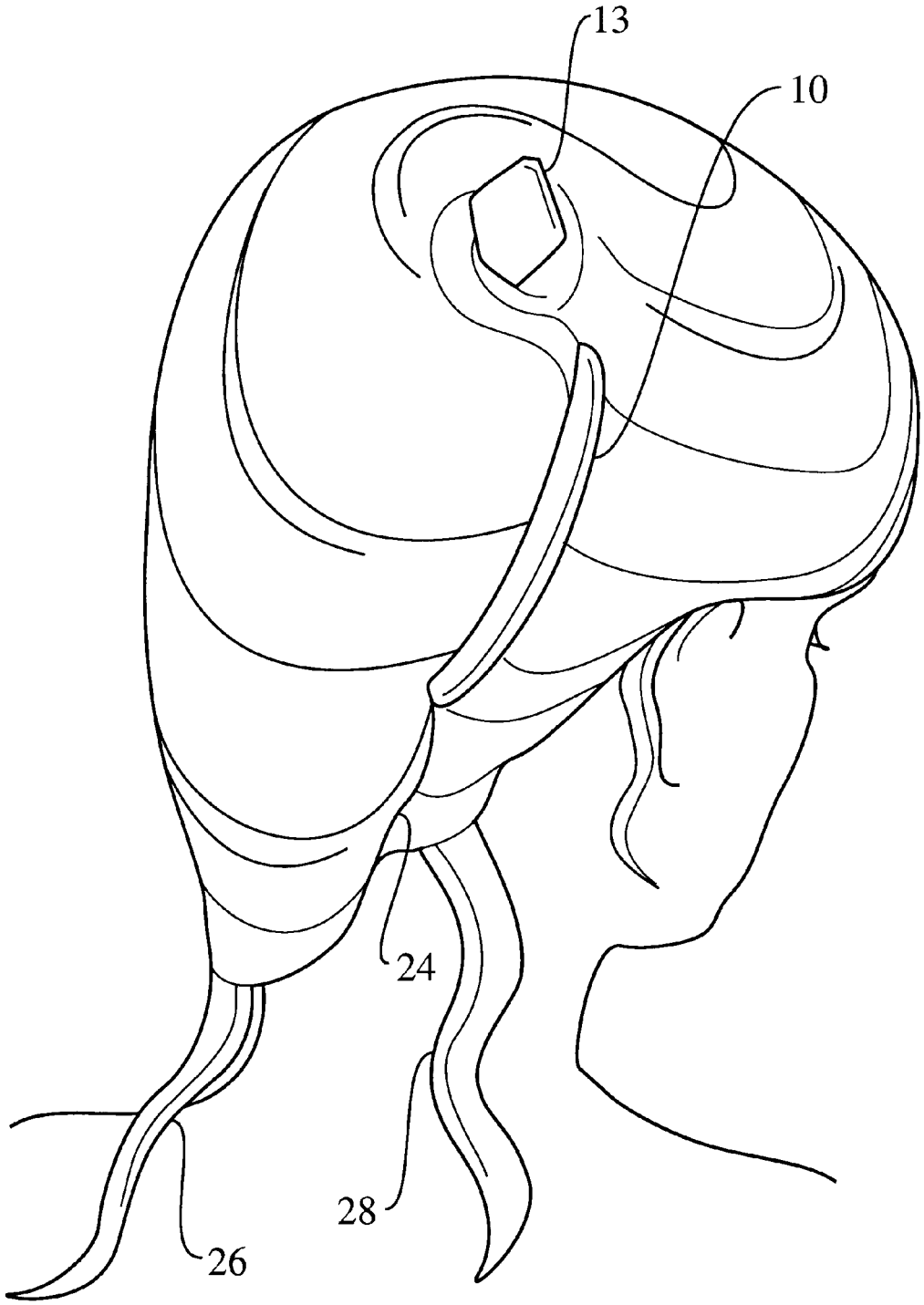
FIG. 4 is a perspective view of the back of a person's head showing a French twist and one end of a locking pin of the invention.

As shown in FIG. 4 a French twist typically involves folding one side of a bundle or bun of hair over the bundle or bun to form a crease or indentation 24 which extends upward from the person's neck toward the crown of the head. Central strands of hair corresponding to the outer strands 26 and 28 have been folded upward into the bun. Thus, the central strands may form a tail which is folded along its length into a layered bun or structure.

With the hair folded and twisted as shown in FIG. 4, the teeth of a comb of the invention are inserted laterally into the edge of the twisted structure so as to capture strands of hair in the layers of the twisted structure. The top of the spine, the top of the twist, and the top of the channel in the teeth are preferably just below the top of the bun. The point or end 11 of the pin 12 is then passed down through the passageway or channel 22 to wedge the captured strands of hair in the channel in place. The pin is preferably tapered along its length. The head 13 of the pin is barely seen in FIG. 4; and indeed, it is a feature of the invention that the pin may be largely hidden following its insertion.

The user may choose to supplement the comb and its pin with additional fasteners such as additional combs of the invention or bobby pins or the like; however, it is an advantage of the invention that the use of a single comb and pin of the invention is deemed to be sufficient in the large majority of applications and is particularly suited for French twists. It is a particular advantage that the comb and its pin may be installed readily by the wearer.

It is known that human hair varies greatly in its texture, thickness, oiliness, length and other properties. Consequently, the best sizes of comb and pin, and their best location in any given twist, bun or the like may vary somewhat from one application to the next. It has been experienced, however, that very little practice or experimentation is normally necessary to deal successfully with any given application.

It will also be apparent that the invention is not limited in its use to the French twist hair style. It is applicable to many styles which involve buns, twists and the like where layers of hair are present. The head of the pin may take many forms, but it is preferably large enough not to slip through the channel defined by the teeth. The offset portions 20 of the teeth may also take different configurations or profiles, as for example, shallow curvatures, deep curvatures, rectangular, triangular, serrated and the like. Moreover, the portions of the teeth on the opposing sides of the channel may be relatively straight and curved as shown in the figures, or they may both be curved or otherwise configured so long as they define an adequate channel or passageway for hair to enter and be wedged. It is generally preferred that two sets of teeth be employed and that the teeth in one set alternate with teeth in the other set along the length of a comb. It is also generally preferred that the points or tapered ends of both sets of teeth be in alignment along a channel. It may be preferable to taper the size of the channel along its length to help create a wedging relationship with a pin inserted into the channel. This may be obtained by progressively reducing the offset or displacement between the two sets of teeth along the comb from the entrance to the channel.

As noted earlier, more than one channel may be formed by the teeth of a comb of the invention. In this case a separate pin is used with each channel. The pins themselves should be thick enough and preferably tapered to effect a wedging action when inserted into a channel. Locking features may be incorporated in the pins to hold them in place within combs. Thus, the body or head of a pin may be notched to engage a tooth when it reaches an operative position within a comb. Indeed, a pin may be notched or serrated along its length to engage a plurality of teeth when in operative position.

As noted earlier, a variety of locking relationships may be employed between the comb and a pin. Thus the pin may be configured at one or more points along its length to engage one or more teeth. Examples of configurations may include notches to engage one or more teeth or raised axial sections tailored to lodge between two adjacent teeth. Such notches and raised sections would typically be placed near the head or proximal end of the elongated member. Alternatively, the head of the elongated member may be shaped to be adjacent to the spine of the comb; and, the head and the spine may be provided with locking features or elements such as magnets, Velcro patches, snaps or other reliable fasteners.

Figure 5A:
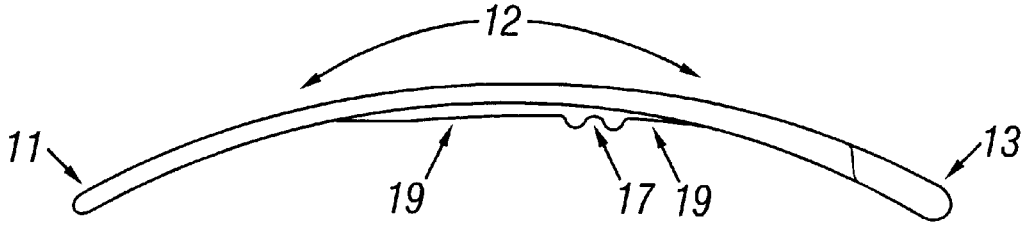
FIG. 5A and FIG. 5B are side and top views of an elongated locking member or pin especially configured to engage a comb of the invention.
Figure 5B:
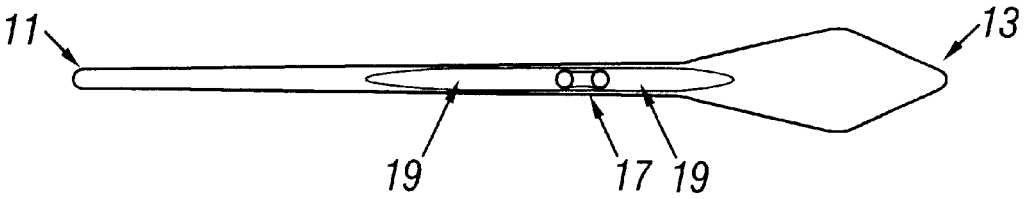

One preferred locking pin is shown in side (FIG. 5A) and top view (FIG. 5B). The pin 12 which is generally similar to the pin 12 in FIG. 1 has a head end 13 and tapers to its opposite rounded end or point 11. About midway along its length the pin thickens to resemble a ramp 19 leading to a notch 17. As the pin 12 enters a channel 22 (see FIG. 1), a selected tooth (typically the relatively straight tooth nearest to the head rides up the ramp and snaps into the notch 17 to effect a locking arrangement or engagement between the pin 12 and the comb 10 (FIG. 1). The pin typically is about five inches (about 125 mm) long and has a head about 10/16 inch (about 16 mm) wide. The pin is also curved along its length to correspond to the curvature of the channel.

An elongated member or pin of the invention may vary in cross section, being circular, oval, rectangular or other polygonal shape. Generally preferred shapes are circular, rectangular or oval.

As also noted earlier, the teeth of a comb of the invention may have different profiles, especially in the sections which form a channel for the insertion of a pin. Thus, the sections may form two sets having two different curvatures as shown in FIG. 1. They may also have angular profiles such as rectangular or triangular. Whatever the profile, a sufficient number of the sections must be offset enough relative to other sections in their profiles to define an operative channel for a closely fitting pin. In other words a pin must fit within a channel closely enough to wedge strands of hair as explained above.

Figure 6:
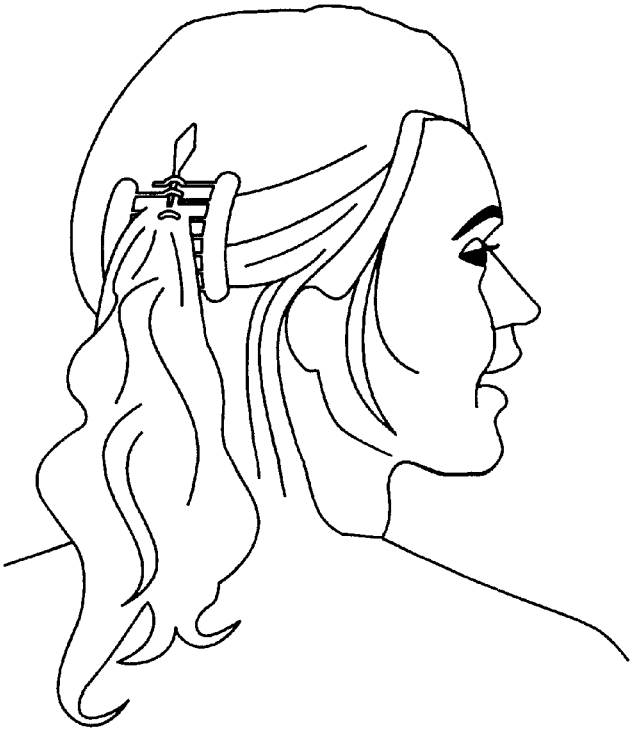
FIG. 6 is a perspective view of an embodiment of the invention which employs two combs in stabilizing a tail hairstyle on the back of a person's head.

An embodiment of the invention employing two combs is shown in FIG. 6 stabilizing a hair style similar to a ponytail on the back of a person's head. It will be noted that the teeth of the combs are exposed for purposes of explanation; actually, they would be embedded in the hair style and essentially out of sight. As explained earlier, the sets of teeth on the combs are shaped to define a channel extending along and between the combs when placed in an operative position within a hair style. Thus, the teeth on one comb may be arched relative to the teeth on the other comb. When the combs are in operative position, a locking pin may be inserted into the channel and locked to one or both combs.

It will be apparent in FIG. 6 that the teeth of the two combs may be adapted to enter a hairstyle from the same direction to form a channel between the combs. This use of two combs as in FIG. 6, however, is less preferred than the use of a single comb having two sets of channel forming teeth.

A preferred marketing system for the invention comprises a kit containing one or more combs and one or more locking pins of the invention. It is especially preferred that any given such comb be packaged with a plurality of locking pins having different size cross sections. Thus, a person with less abundant hair than another person may prefer to use a thicker locking pin than the other person. It is also preferred that the combs and locking pins be contained in a clean or sterilized form and blister packed, vacuum wrapped or otherwise sealed for the convenience and safety of the wearer.

In application, a person first assembles a French twist or other upswept hair style on the head. This is typically done by gathering hair in the form of a tail and then folding the tail along the tail into the desired hair style. The teeth of a comb or of a pair of combs of the invention are next inserted into the style to form a channel, and hair strands throughout the style are captured in the channel. A locking pin, preferably including a locking element, is then inserted into the channel into an operative position where the captured hair is wedged against surrounding channel-forming comb teeth. At this point a locking feature of the pin element is releasably engaged with the comb or the pair of combs to lock the comb and or the pair and the captured hair in place.

What is claimed:

1. Hair styling apparatus which comprises:

a) a comb including a first set of teeth and a second set of teeth wherein teeth of the second set alternate along the comb with teeth of the first set and are shaped along a part of their length relative to the teeth of the first set to define a channel extending along the comb and between the two sets of teeth; and b) a pin configured to fit removably within and along the channel, said pin including a locking feature adapted to engage the comb in locking relation in operative position.

2. Apparatus as defined in claim 1 wherein the channel is spacious enough to capture numerous stands of hair from within a hair style when the two sets of teeth are in operative position within the hair style, and the pin is sized to fit closely between the two sets of teeth when inserted in the channel to wedge captured hair within the channel.

3. Apparatus as defined in claim 1 wherein the teeth of both sets are curved along their length to conform to the shape of a human head.

4. Apparatus as defined in claim 1 wherein the comb and the pin are curved along their length to conform to the shape of a human head.

5. Apparatus as defined in claim 1 wherein the pin includes an enlarged head at one end to restrict that end of the pin from entering the channel.

6. Apparatus as defined in claim 5 wherein the comb includes a companion fastener for the locking feature on the pin and is adapted to engage the locking feature when in an operative position within the channel.

7. Apparatus as defined in claim 5 wherein the pin is configured along its length to engage one or more teeth of the comb when in an operative position within the channel.

8. A hair styling device which comprises a comb having a spine and a row of teeth wherein corresponding sections of some of the teeth alternate with and are displaced relative to the corresponding sections of the other teeth to define a ribbed channel extending along the comb and between said corresponding sections of said some teeth and said other teeth and, a locking pin configured to fit within said ribbed channel, said locking pin including a locking feature adapted to engage the comb in releasable locking relation when in operative position within said channel.

9. A hair styling device as defined in claim 8 wherein said sections of said other teeth are relatively straight and said sections of said some teeth are offset relative to said sections of said other teeth to define said ribbed channel.

10. A hair styling device as defined in claim 9 wherein the sections of said other teeth and the sections of said some teeth have curved profiles along their length.

11. A hair styling device as defined in claim 9 wherein the sections of said some teeth have angular profiles along their length.

12. A method of styling hair on the human head which comprises:

a) gathering stands of the hair in a tail;

b) folding the tail along its length to form a layered hair structure on the head;

c) providing a comb having a row of teeth wherein some of the teeth distributed along the row and between the other teeth have portions along their length which are offset relative to the other teeth to define a channel with the other teeth extending along the comb;

d) inserting the comb into the layered hair structure such that strands of hair in the layered hair structure are captured in the channel;

e) wedging an elongated pin member into the channel to hold the captured strands of hair and the layered hair structure in place; and f) releasably locking the wedged elongated pin member to the comb.

13. Apparatus for holding a bun, twist or other layered hair structure in place which comprises:

a) a comb having a spine and a row of teeth which are shaped along their lengths and relative to one another to define a ribbed channel extending along the row and between the teeth, said channel being large enough to capture strands of hair when inserted in a layered hair structure; and, b) an elongated, tapered locking pin insertable in the channel to wedge the captured strands of hair against the shaped teeth in operative position, said pin including a locking feature adapted to engage the comb in releasable locking relation when the pin is in said operative position.

14. Apparatus as defined in claim 13 wherein the locking pin is notched to engage one or more of said teeth.

15. A hair styling kit comprising:

(a) a first comb having a plurality of teeth wherein some of the teeth distributed along the comb and between the remaining teeth have sections along their length which are offset relative to the remaining teeth to define a channel extending along the comb and between said some teeth and said remaining teeth; and (b) a locking pin packaged with said first comb and configured to be inserted into said channel, said locking pin including a locking feature capable of engaging the comb in a releasable locking relation when inserted into an operative position within the channel.

16. A hair styling kit as defined in claim 15 and further comprising at least one additional said locking pin packaged with said first comb, at least 80 mm of said locking pins varying in thickness.

17. A hair styling kit as defined in claim 16 and further comprising at least on additional said comb packaged with said first comb and said locking pins.

18. A hair styling kit as defined in claim 15 wherein said some teeth alternate with said remaining teeth along said comb.

19. A hair styling kit as defined in claim 15 wherein the locking pin includes a locking feature capable of engaging the comb when inserted within the channel.

20. A hair styling kit as defined in claim 19 wherein the locking feature comprises a notch configured to engage a tooth of the comb.

21. A hair styling kit as defined in claim 19 wherein the locking feature comprises a first fastener mounted on the locking pin and the comb includes a companion fastener capable of engaging the first fastener.

22. Hair styling apparatus comprising two sets of comb teeth wherein the teeth in one set include corresponding sections along their length shaped relative to corresponding sections along the teeth of the other set to define a channel extending along and between the two sets when the sets are interlaced to define a row of said teeth with the teeth of the one set alternating with the teeth of the other set; and a locking pin adapted to be inserted into the channel, said locking pin including one or more locking features capable of releasably engaging teeth of one or both sets in locking relation with said sets in operative position.

23. Hair styling apparatus as defined in claim 22 which further comprises a single comb spine attached to corresponding ends of both sets of teeth to form a single comb.

24. Hair styling apparatus as defined in claim 22 which further comprises a separate comb spine attached to corresponding ends of each set of comb teeth to form two separate combs.

25. Hair styling apparatus as defined in claim 23 wherein the locking pin includes a locking feature configured to engage the comb.

26. Hair styling apparatus as defined in claim 24 wherein the locking pin includes a locking feature configured to engage one of the combs.

27. A device for holding an upswept hair style in place which comprises:

a) a comb having a spine and a row of teeth extending along the spine; said row of teeth including two sets of teeth which alternate along the spine, a first said set comprising generally straight teeth and a second set comprising teeth with corresponding sections along their length which are displaced relative to the first set of teeth to define a ribbed channel extending along the comb and between the two sets of teeth sufficiently large to capture numerous strands of hair from an upswept hair style when the two sets of teeth are inserted into the upswept style; and b) a locking pin removably insertable into the channel to an operative position wedging the captured hair in the channel, said locking pin including a first locking feature adapted to releasably engage the comb in locking relation when the locking pin is in said operative position.

28. A device as defined in claim 27 wherein the comb includes a companion locking feature for the first locking feature capable of interengaging the first locking feature when the locking pin is in its said operative position in said ribbed channel.

29. A device as defined in claim 27 wherein the first locking feature comprises a notch configured to engage a tooth of the comb.

30. A device as defined in claim 27 wherein the comb is curved along its length to conform to the shape of the human head.

31. A device as defined in claim 27 wherein the two sets of teeth alternate every other tooth.

* * * * *